US005651429A

United States Patent [19]

Lin

[11] Patent Number: 5,651,429

[45] Date of Patent: Jul. 29, 1997

[54] ELEVATOR SAFETY APPARATUS

[76] Inventor: Wen-Tsung Lin, 3Fl. No. 18, Lane 30, Hsing Hwa Road, Nan Kang, Taipei, Taiwan

[21] Appl. No.: 420,925

[22] Filed: Apr. 12, 1995

[51] Int. Cl.[6] ..... B66B 5/16

[52] U.S. Cl. ..... 187/363

[58] Field of Search ..... 187/287, 289, 187/359, 361, 363, 367

[56] References Cited

U.S. PATENT DOCUMENTS

| | | | |
|---|---|---|---|
| 289,905 | 12/1883 | Fitzroy | 187/363 |
| 366,745 | 7/1887 | Taylor et al. | 187/363 |
| 435,232 | 8/1890 | Lynn | 187/363 |
| 1,020,458 | 3/1912 | Smith | 187/363 |
| 1,058,154 | 4/1913 | Collins | 187/363 |
| 1,220,992 | 3/1917 | Rydlewski | 187/363 |
| 2,511,697 | 6/1950 | Clift | 187/287 X |
| 5,377,786 | 1/1995 | Nakagawa | 187/289 X |

FOREIGN PATENT DOCUMENTS

| | | | |
|---|---|---|---|
| 6926655 | 7/1981 | China . | |
| 2618420 | 1/1989 | France | 187/361 |
| 1456352 | 2/1989 | U.S.S.R. | 187/361 |
| 1429181 | 3/1976 | United Kingdom | 187/367 |

*Primary Examiner*—James W. Keenan
*Attorney, Agent, or Firm*—Lowe, Price, LeBlanc & Becker

[57] ABSTRACT

Provided is an elevator safety apparatus for use by an elevator to prevent the elevator from free-falling in emergency conditions. The elevator safety apparatus is also capable of cutting off the power to the elevator's motor and triggering a beeper when it stops the elevator. In normal conditions of the elevator, a stopping bar is suspended due to a weight such that the engaging head of the stopping bar maintains a distance from stopping teeth provided on the guide rail that guides the elevator. And in emergency conditions when the elevator is subject to free-falling, the engaging head of the stopping bar is moved upwards by elastic force due to the loss of the gravitational force exerted by the weight during the free-falling, thereby coming into engagement with one of the stopping teeth and thus stopping the elevator. The elevator safety apparatus is simple in structure, having fewer movable parts so that it is more reliable.

7 Claims, 4 Drawing Sheets

ELEVATOR SAFETY APPARATUS

BACKGROUND OF THE INVENTION

1. Field of the Invention

The present invention relates to elevators, and more particularly, to an elevator safety apparatus that can prevent the elevator from uncontrolled descent when, for instance, the cord pulling the elevator breaks off or the motor stalls.

2. Description of Prior Art

A prior art elevator safety apparatus is disclosed in ROC Application No. 6,926,655, which is shown in FIGS. 5–6. In this prior art elevator safety apparatus, steel core 1 supports the hanging structure 3 through pulley 2. The opposite ends of the hanging structure 3 are inserted into securing frames 5 which allow the hanging structure 3 to be movable along the vertical direction. A pair of grooved plates 6 extend from two sides of the hanging structure 3. A pressing member 7 is provided at the outer end of the grooved plate 6. A pair of securing rods 8 is sleeved with spring 9, with its two ends passing through the grooved plate 6 and secured to the top of the elevator 4. In normal conditions, since the elevator 4 is suspended by the steel cord 1, the spring 9 is depressed by gravitational pull. In emergency conditions when the steel cord 1 breaks off, the elastic force from the spring 9 presses the grooved plate 6 and the pressing member 7 and hanging structure 3 down against the top of the elevator 4. The stopping device B is mounted on the grooved plates 10 and attached to guiding posts 11. The grooved plate 10 and the angled iron plate 12 constitute a mount for a braking member 13. A threaded bar 15 is engaged with a threaded hole 14*a*. A ball 16 is inset at the head of the threaded bar 15, which presses against a pushing member 17. The top and bottom of the pushing member 17 are each provided with a cylindrical member 18. The other end of the cylindrical body is inserted at the back of the braking member 13. A linkage arm 19 is provided with its center pivoted at the rear end of the threaded bar 15. Its upper portion is coupled to the bottom of the pressing member 17 via pulleys and its lower portion is coupled to the linkage bar 20. The elevator safety apparatuses B, B', and B" are all identical in structure. One end of the linkage arm 21 is connected to the outer end of the threaded bar on the elevator safety apparatus B' and the other end connected to the linkage bar 20. The elevator safety apparatus B" is also connected to the linkage bar via the linkage arm 22. When the linkage arms 19, 21, 22 are pushed in a specific direction, the threaded bar 15 on each elevator safety apparatus B, B' and B" screws forward into the box 14. Concurrently, the pushing member 17, the cylindrical member 18, and the braking member 13 move toward the guiding post 11. This causes friction between the braking member 13 and the guiding post 11.

In an emergency condition when the cord pulling the elevator breaks off, the pressure exerted to the spring 9 disappears such that the elasticity of the spring 9 forces the pressing member 7 to press down against the underlying linkage arm 19 which in turn transmits the pressure to the linkage arms 21, 22 via the linkage bar 20 at the other end, causing the braking devices B, B' and B" to operate and thereby stopping the elevator 4.

It is a drawback of the aforementioned prior art that constituent parts of the braking devices B, B', and B" and those of the transmission mechanism from the pulley 2 to the braking devices B, B', and B" are so numerous that the structure is quite complex. This makes the prior art elevator safety apparatus slow in action, liable to easy malfunction, and hard to maintain.

In the prior art elevator safety apparatus, the elevator's motor is not switched off when the elevator is stopped in emergency conditions. This usually causes the circuit of the motor to break down and can thus cause fire.

In addition, there exists a need for a beeper that can produce an alarm or SOS call to the outside when the elevator is in an emergency situation.

SUMMARY OF THE INVENTION

It is a primary objective of the present invention to provide an elevator safety apparatus which can stop the elevator in emergency conditions.

It is another objective of the present invention to provide an elevator safety apparatus which is simple in structure.

It is still another objective of the present invention to provide an elevator safety apparatus which can cut off the power supply to the motor in an emergency condition.

It is yet another objective of the present invention to provide an elevator safety apparatus which can automatically issue an SOS call in an emergency condition.

In accordance with the foregoing and other objectives of the present invention, there is provided an elevator safety apparatus for use by an elevator to prevent the elevator from free-failing. The elevator safety apparatus includes a guide rail for guiding the elevator. The guide rail is formed with a series of stopping teeth. A stopping bar provided inside the elevator safety apparatus has one engaging head and is rotatable around a pivot. A weight is affixed to the stopping bar at a first position between the engaging head of the stopping bar and the pivot. Elastic means such as a spring is affixed to the stopping bar at a second position on the stopping bar substantially opposite to the first position where the weight is affixed. The elastic means exerts a pulling force less than the gravitational force exerted by the weight to the stopping bar.

By the foregoing arrangement, in normal conditions of the elevator, the stopping bar is suspended due to the weight such that the engaging head of the stopping bar maintains a distance from the stopping teeth on the guide rail. And in emergency conditions when the elevator is subject to free-falling, the engaging head of the stopping bar is moved upwards by the spring due to the loss of the gravitational force exerted by the weight during the free-falling. Thus, the engaging head of the stopping bar comes into engagement with one of the stopping teeth, thereby stopping the elevator.

The elevator safety apparatus according to the present invention further includes a switch set including a first switch connected to the elevator motor and a second switch connected to an emergency beeper. The first switch and the second switch are triggered by the stopping bar when the stopping bar is stopped in emergency conditions.

The advantages of the elevator safety apparatus according to the present invention over prior art include that the structure is greatly simplified. The elimination of a transmission mechanism between the stopping bar and the stopping teeth of the guide rail also makes the structure more simple. Among the constituent elements, only the stopping bar and the spring are movable parts. Therefore, the apparatus is more reliable.

BRIEF DESCRIPTION OF THE DRAWINGS

The present invention can be more fully understood by reading the subsequent detailed description of the preferred embodiments thereof with references made to the accompanying drawings, wherein.

DETAILED DESCRIPTION OF THE PREFERRED EMBODIMENTS

Referring to FIGS. 1–4, the elevator safely apparatus according to the present invention includes a guide rail 10 provided along the path of the elevator 4 and a stopping device 20 provided at the top of the elevator 4. The elevator 4 can be installed with two sets of guide rails 10 and slopping device on both sides.

Figure 1:
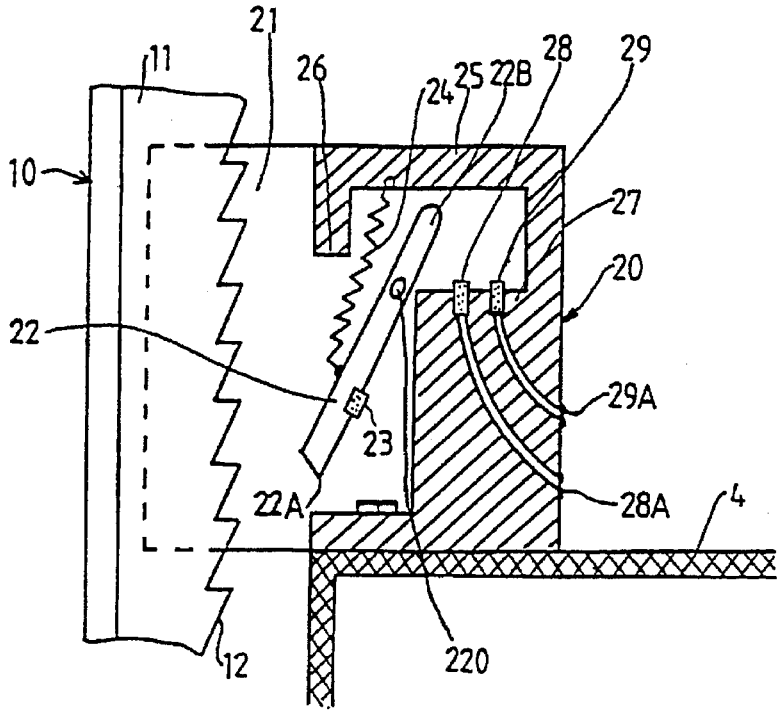
FIG. 1 is a cross-sectional view of an elevator safety apparatus according to the present invention.

The guide rail 10 is provided with a protruded portion 11 on the side facing the elevator 4. A series of stopping teeth 12 are provided on the front edge of the guiding portion 11. Each stopping tooth is shaped as illustrated in FIG. 1.

Figure 2:
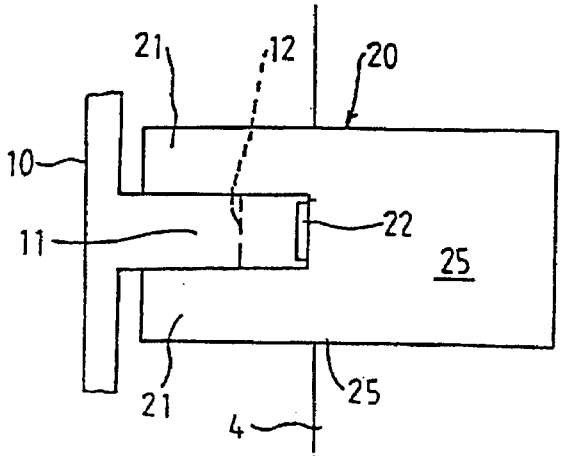
FIG. 2 shows a top view of the elevator safety apparatus according to the present invention.
Figure 3:
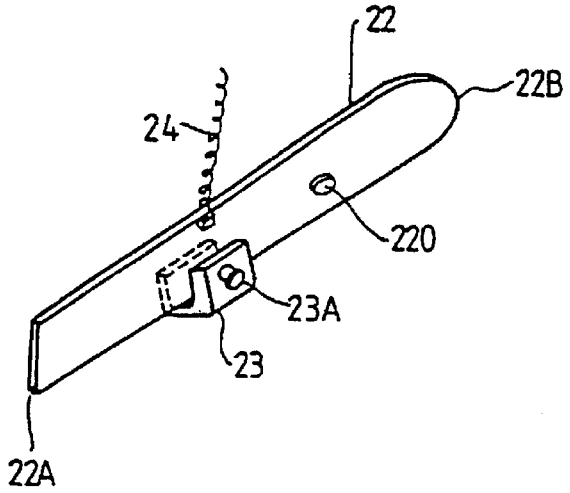
FIG. 3 shows a stopper bar employed in the elevator safety apparatus according to the present invention.

As shown in FIG. 2, the stopping device 20 is formed with a pair of guide plates 21 coupled freely to the protruded portion 11 on the guide rail 10 such that the elevator 4 can be guided by the guide rail 10 to run upwards or downwards.

shown in FIG. 3, the stopping device 20 includes a stopping bar 22 rotatable around a pivot 220 and having a spear-like head 22A. A weight 23 is fixed between the pivot 220 and the head 22A of the slopping bar 22, which is U-shaped so that it can be mounted onto the stopping bar 22 and secured by a screw 23A. The position of the weight 23 is adjustable by loosening the screw 23A and manually moving it to the desired position opposite to where the weight 23 is mounted. The other end of the spring 24 is affixed on the ceiling 25 of the casing of the stopping device 20. It is an important aspect of the present invention that the weight 23 must exert a gravitational pull on the stopping bar 22 larger than the elastic force exerted by the spring 24. In the stopping device 20, a protruding block 26 is formed above the stopping bar 22, which can stop the movement of the stopping bar 22 when the head 22A of the stopping bar 22 is engaged with a tooth on the guide rail 10 and thereby rotated in the clockwise direction (viewing from the side shown in FIG. 4).

A switch set 27 is provided in an upper room within the casing of the stopping device 20, which includes a first switch 28 connected via a first contact 28A to the motor (not shown) driving the elevator 4 and a second switch 29 connected via a second contact 29A to an emergency beeper (not shown). The stopping bar 22, when stopped by the protruding block 26, has its rear end touching the switch set 27, thereby triggering the two switches 28, 29. Further to the herein described function, the switch set 27 also acts as a stopper in cooperation with the protruding block 26 that stops the rotation of the stopping bar 22.

The elevator 4 moves upwards or downwards through the guiding of the guide rail 10. In normal conditions, the stopping bar 22, due to the weight 23, is suspended downwards as illustrated in FIG. 1; the head 22A of the stopping bar 22 maintains a distance from the teeth 12 on the guide rail 10; and the first switch 28 connected to the elevator's motor is in connection (closed) status and the second switch 29 connected to the emergency beeper is in disconnected (open) status.

Figure 4:
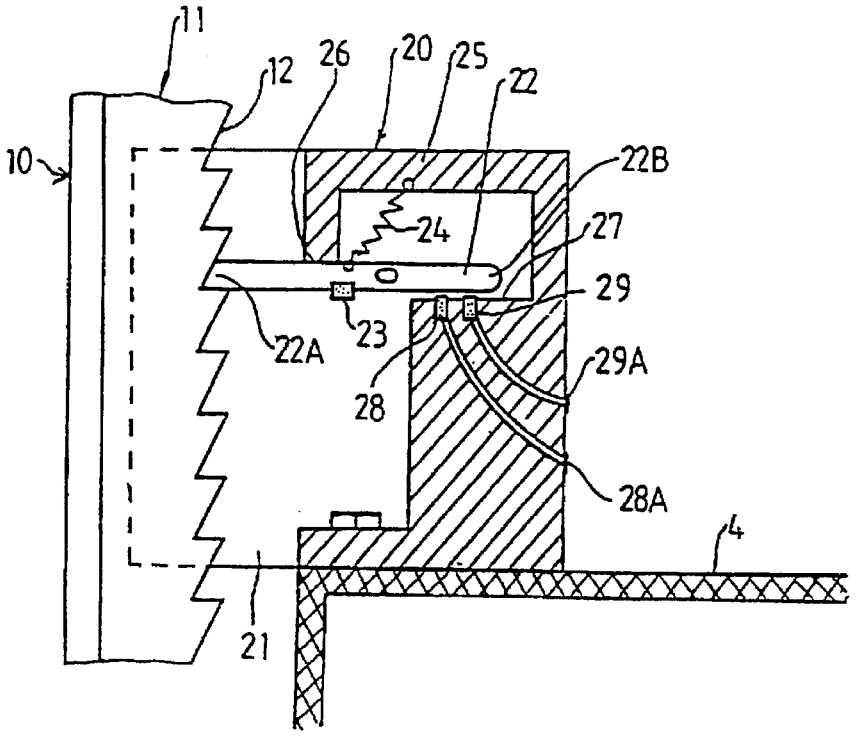
FIG. 4 shows how an elevator is stopped in an emergency condition by the elevator safety apparatus according to the present invention.
Figure 5:
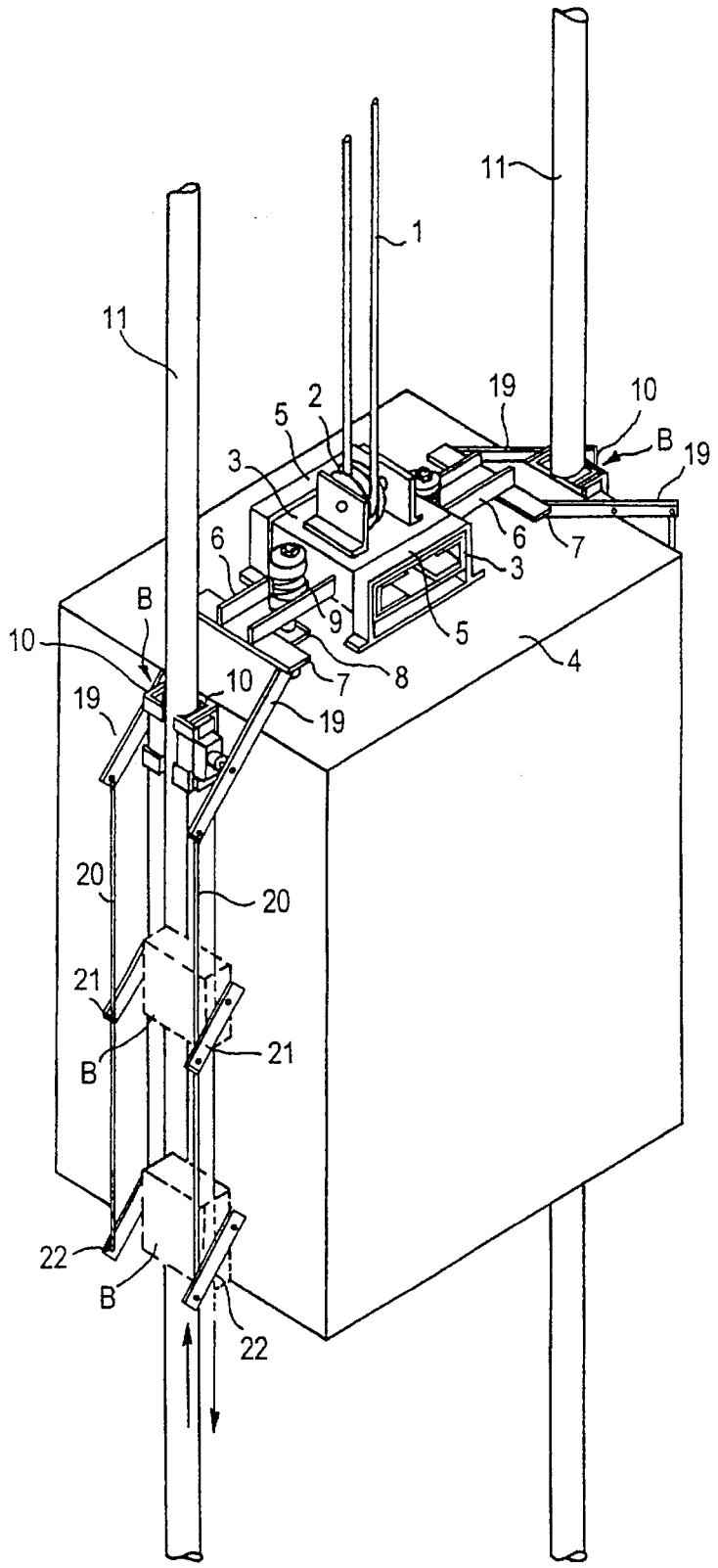
FIG. 5 PRIOR ART
FIG. 5 shows an elevator which utilizes a prior art elevator safety apparatus.
Figure 6:
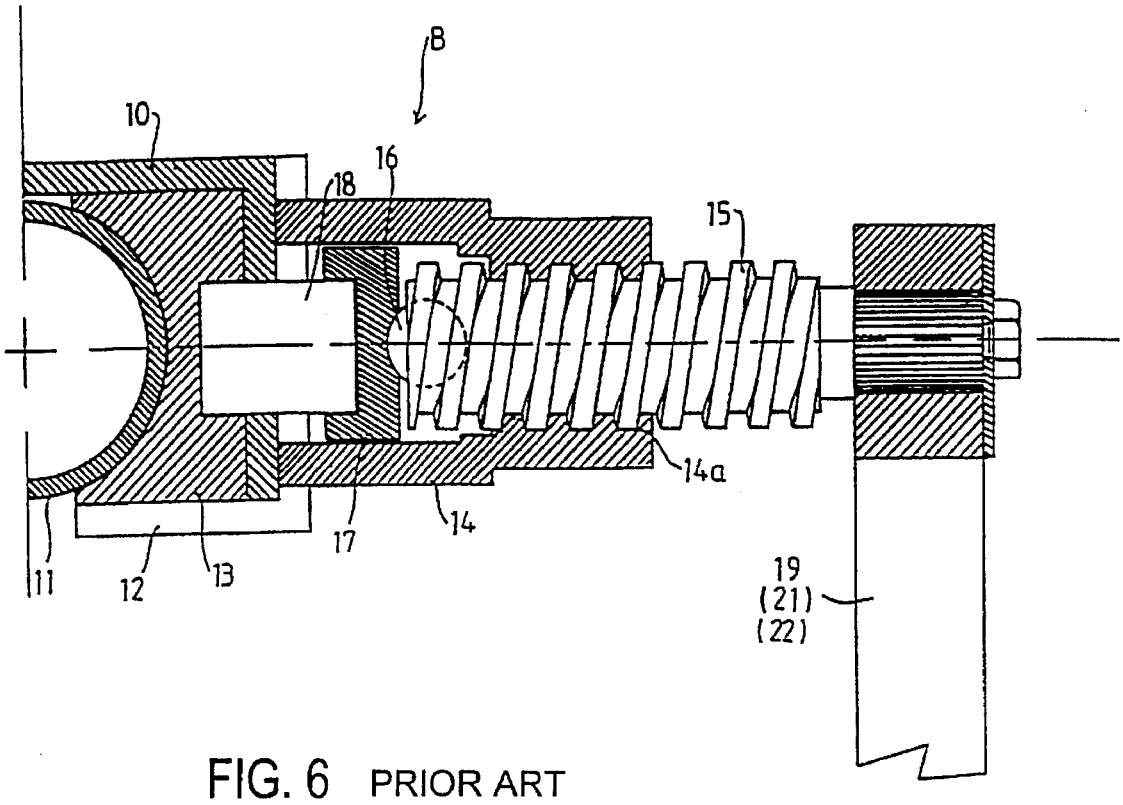
FIG. 6 PRIOR ART
FIG. 6 shows a braking device employed in the prior art elevator safely apparatus of FIG. 5.

In emergency conditions, when, for instance, the cord pulling the elevator breaks off or the elevator's motor stalls, thereby causing the elevator to be subject to free-falling, the weight 23 loses its gravitational pull on the stopping bar 22. As a consequence, the elastic force of the spring 24 at this time is greater, thereby pulling the head 22A of the stopping bar 22 upwards and thus causing the head 22A to be engaged with one tooth on the guide rail 10. As shown in FIG. 4, when the stopping bar 22 is stopped by the protruding block 26, the engagement of the head 22A with one tooth on the guide rail 10 stops the descent of the elevator 4. At the same time, the rear end of the stopping bar 22 touches the switch set 27, causing the switches 28, 29 to be triggered, thereby cutting off power to the elevators motor and connecting the power to the emergency beeper.

When the cause of the emergency condition is fixed, the engagement between the head 22A of the stopping bar 22 and tooth of the guide rail 10 can be disengaged by simply moving the elevator 4 upwards. This returns the stopping bar 22 to the suspended condition as illustrated in FIG. 1.

As described in the foregoing, the structure of the elevator safety apparatus according to the present invention is greatly simplified compared to the prior art. The elimination of a transmission mechanism between the stopping bar 22 and the stopping teeth 12 of the guide rail 10 also makes the structure more simple.

In the constituent elements of the elevator safety apparatus according to the present invention, only the stopping bar 22 and the spring 24 are movable parts. Therefore, the apparatus is more reliable.

The present invention has been described hitherto with an exemplary preferred embodiment. However, it is to be understood that the scope of the present invention need not be limited to the disclosed preferred embodiment. On the contrary, it is intended to cover various modifications and similar arrangements within the scope defined in the following appended claims. The scope of the claims should be accorded the broadest interpretation so as to encompass all such modifications and similar arrangements.

What is claimed is:

1. An elevator safety apparatus for preventing an elevator from free-falling, which apparatus comprises:

(a) a guide rail for guiding the elevator, said guide rail being formed with a series of stopping teeth;

(b) a stopping bar having one engaging head and being rotatable around a pivot;

(c) a weight affixed to said stopping bar at a first position along the length of said stopping bar between the engaging head and said pivot; and (d) elastic means affixed to said stopping bar at a second position along the length of said stopping bar substantially opposite to said first position where said weight is affixed, said elastic means exerting a pulling force less than the gravitational force exerted by said weight to said stopping bar;

whereby in normal conditions of the elevator, said stopping bar is suspended due to said weight so that the engaging head of said stopping bar maintains a distance from said stopping teeth on said guide rail; and whereby in emergency conditions when the elevator is subject to free-falling, the engaging head of said stopping bar being moved upwards by said elastic means due to the loss of the gravitational force exerted by said weight during the free-falling, thereby coming into engagement with one of said stopping teeth and thus stopping the elevator.

2. An elevator safety apparatus according to claim 1, further comprising a switch set including a first switch adapted for connection to an elevator motor and a second switch connected to an emergency beeper.

3. An elevator safety apparatus according to claim 2, wherein said first switch and said second switch are triggered by said stopping bar when said stopping bar is stopped in emergency conditions.

4. An elevator safety apparatus according to claim 3, wherein said first switch and said second switch are triggered by the pressure from the rear end of said stopping bar when the elevator is stopped in emergency conditions.

5. An elevator safety apparatus according to claim 1, further comprising a protruding block that stops said stopping bar when said stopping bar is moved upwards in emergency conditions.

6. An elevator safety apparatus according to claim 1, wherein the position of said weight is adjustable along the length of said stopping bar.

7. An elevator safety apparatus according to claim 1, wherein said elastic means is a spring.

* * * * *